US007811394B2

(12) United States Patent
Henry et al.

(10) Patent No.: US 7,811,394 B2
(45) Date of Patent: Oct. 12, 2010

(54) ALUMINUM ALLOY STRIPS FOR HEAT EXCHANGERS

(75) Inventors: Sylvain Henry, Voiron (FR); Nathalie Remond, Colmar (FR); Bruno Chenal, Saint Etienne de Crossey (FR)

(73) Assignee: Pechiney Rhenalu, Paris (FR)

( * ) Notice: Subject to any disclaimer, the term of this patent is extended or adjusted under 35 U.S.C. 154(b) by 1007 days.

(21) Appl. No.: 10/495,118

(22) PCT Filed: Nov. 12, 2002

(86) PCT No.: PCT/FR02/03866

§ 371 (c)(1),
(2), (4) Date: Jul. 8, 2004

(87) PCT Pub. No.: WO03/044235

PCT Pub. Date: May 30, 2003

(65) Prior Publication Data

US 2005/0034793 A1 Feb. 17, 2005

(30) Foreign Application Priority Data

Nov. 19, 2001 (FR) ..... 01 14948

(51) Int. Cl.
*C22F 1/04* (2006.01)

(52) U.S. Cl. ..... 148/437; 148/551

(58) Field of Classification Search ..... 148/551, 148/437

See application file for complete search history.

(56) References Cited

U.S. PATENT DOCUMENTS 4,737,198 A 4/1988 Shabel et al.
5,476,725 A * 12/1995 Papich et al. ..... 428/654
5,518,064 A 5/1996 Romanowski et al.
6,165,291 A * 12/2000 Jin et al. ..... 148/551

FOREIGN PATENT DOCUMENTS

EP 0039211 11/1981
EP 0694356 1/1996
JP 01034548 A * 2/1989

(Continued)

OTHER PUBLICATIONS

English translation of JP 01034548. (Feb. 6, 1989).*

(Continued)

*Primary Examiner*—Roy King
*Assistant Examiner*—Jie Yang
(74) *Attorney, Agent, or Firm*—Dennison, Schultz & MacDonald

(57) ABSTRACT

Aluminum alloy strips less than 0.3 mm thick for making heat exchangers, containing, in wt. %: Si<1.0, Fe<1.0, Cu<0.8, Mg<1.0, Mn≦1.8, Zn<2.0, In<0.2, Sn<0.2, Bi<0.2, Ti<0.2, Cr<0.25, Zr<0.25, Si+Fe+Mn+Mg>0.8, other elements <0.05, each and <0.15 in total. The strips have between the surface and half the thickness a difference of corrosion potential, measured relative to a saturated calomel electrode in accordance with the ASTM G69 standard, of at least 10 mV. The invention also concerns a method for making such strips by continuous casting in conditions promoting formation of segregations in the strip core, optionally hot rolling, cold rolling optionally with one or several intermediate or final annealing(s) of 1 to 20 hours at a temperature between 200 and 450° C. The fins or separators made from the inventive strips have enhanced resistance to perforating corrosion.

20 Claims, 2 Drawing Sheets

FOREIGN PATENT DOCUMENTS

| | | |
|---|---|---|
| WO | 9852707 | 11/1998 |

OTHER PUBLICATIONS

Menet et al, XP-002241149 "Light Metals 1997", Proc. Conf. Orlando, FL, pp. 753-756, 1997.

Thomas et al, XP-002241150 "Alumitech '94", Proc. Conf. Atlanta, GA, 427-447, 1994.

Sahoo et al, XP-002241151 "Extraction, Refining and Fabrication of Light Metals"; Edmonds et al, pp. 257-270, 1991.

Jin et al, XP-002241152 "Casting of Near Net Shape Products", pp. 645-653, 1988.

* cited by examiner

ALUMINUM ALLOY STRIPS FOR HEAT EXCHANGERS

This application is a filing under 35 USC 371 of PCT/FR02/03866, filed Nov. 12, 2002.

FIELD OF THE INVENTION

The invention relates to the domain of thin strips (thickness <0.3 mm) made of aluminium alloy for making heat exchangers, particularly heat exchangers used for cooling engines and for air conditioning passenger compartments in motor vehicles. The aluminium alloy strips for exchangers are used either bare or coated on one or both faces with a brazing alloy. The invention more particularly relates to uncoated strips used for fins or separators fixed on tubes or elements in contact with the cooling fluid.

STATE OF THE ART

Aluminium alloys are now very widely used in the manufacturing of heat exchangers for automobiles due to their low density, which enables a weight saving particularly compared with copper alloys, while providing good heat conduction, ease of installation and good corrosion resistance. These exchangers comprise tubes for circulation of internal heating or cooling fluid and fins or separators for heat transfer between the internal fluid and the external fluid, and they are manufactured either by mechanical assembly or by brazing.

In addition to their heat transfer function, the fins or separators must provide protection for tubes against perforation due to the galvanic effect, in other words making the fins from an alloy that has an electrochemical corrosion potential lower than for the tubes, such that the fin acts as a sacrificial anode. The alloy most frequently used for tubes at the moment is the 3003 alloy, therefore an alloy of the same type is usually used for the fins, with an addition of 0.5 to 2% of zinc. The composition of the 3003 alloy registered at the Aluminum Association is as follows (% by weight):

Si<0.6; Fe<0.7; Cu=0.05-0.2; Mn=1.0-1.5; Zn<0.1.

Strips made of this type of alloy are usually obtained by semicontinuous casting of a plate, homogenisation of this plate, hot rolling, then cold rolling possibly with intermediate annealing and/or final annealing. They can also be obtained by continuous casting of strips between two belts (twin-belt casting) or between two cooled rolls (twin-roll casting). It is known that when the twin-roll casting technique is used to obtain Al—Mn alloys with a fine grain structure, the blank is homogenised to eliminate segregations derived from casting, which gives a good compromise between mechanical strength and formability. These properties are described in particular in patent EP 0039211 (Alcan International) for alloys containing between 1.3 and 2.3% of manganese, and in U.S. Pat. No. 4,737,198 (Aluminum Company of America) for alloys containing from 0.5 to 1.2% of iron, less than 0.5% of silicon and 0.7 to 1.3% of manganese that can be used for the manufacture of exchanger fins. Patent application WO 98/52707 issued by the applicant describes a process for manufacturing aluminium alloy strips containing at least one of the elements Fe (from 0.15 to 1.5%) or Mn (from 0.35 to 1.9%) with Fe+Mn<2.5% and possibly containing Si (<0.8%), Mn (<0.2%), Cu (<0.2%), Cr (<0.2%) or Zn (<0.2%) by continuous casting between cooled rolls and rolled to a thickness between 1 and 5 mm followed by cold rolling, the force applied to the casting rolls expressed in tonnes per meter width of strip being less than 300+2000/e, where e is the strip thickness expressed in mm. The use of these strips for making brazed exchanger fins is mentioned.

Patent application WO 00/05426 by Alcan International describes the manufacture of strips for aluminium alloy fins with composition: Fe=1.2-1.8%, Si=0.7-0.95%; Mn=0.3-0.5%, Zn=0.3-2% by continuous casting of strips at a cooling rate or more than 10° C./s.

Patent applications WO 01/53552 and WO 01/53553 by Alcan International also concern the manufacture of strips for iron alloy fins containing up to 2.4% of iron by continuous casting and very fast cooling. The purpose is to obtain a more negative corrosion potential.

SUMMARY OF THE INVENTION

Although fins or separators have to provide a galvanic protection for tubes, they must not be excessively damaged by corrosion during the life of the heat exchanger. Sufficient integrity of the material has to be maintained, because if it is perforated too quickly, the heat exchange will not be as efficient due to the loss of useful area. The fin could even be separated from the tube, which would prevent heat conduction between these components. Thus, the purpose of the invention is to obtain strips for heat exchanger fins or separators made of aluminium alloy that will be used particularly in the automobile industry, that have good mechanical strength, good formability and good resistance to perforating corrosion while acting as a sacrificial anode.

These objectives are achieved by aluminium alloy strips with thickness <0.3 mm, to be used in the manufacture of heat exchangers, with composition (% by weight): Si<1.5; Fe<2.5; Cu<0.8; Mg<1.0; Mn=<1.8; Zn<2.0; In<0.2; Sn<0.2; Bi<0.2; Ti<0.2; Cr<0.25; Zr<0.25; Si+Fe+Mn+Mg>0.8, other elements <0.05 each and <0.15 in total, the remainder being aluminium, with a difference of corrosion potential between the surface and the mid-thickness, measured with respect to a saturated calomel electrode according to ASTM standard G69 equal to at least 10 mV.

The invention also relates to a method for manufacturing such strips by continuous casting under conditions that promote the formation of segregations in the strip core, possibly hot rolling, cold rolling possibly with one or more intermediate or final annealing(s) lasting for 1 to 20 h at a temperature of between 200 and 450° C.

DESCRIPTION OF THE FIGURES

Similarly.

DESCRIPTION OF THE INVENTION

Figure 1:
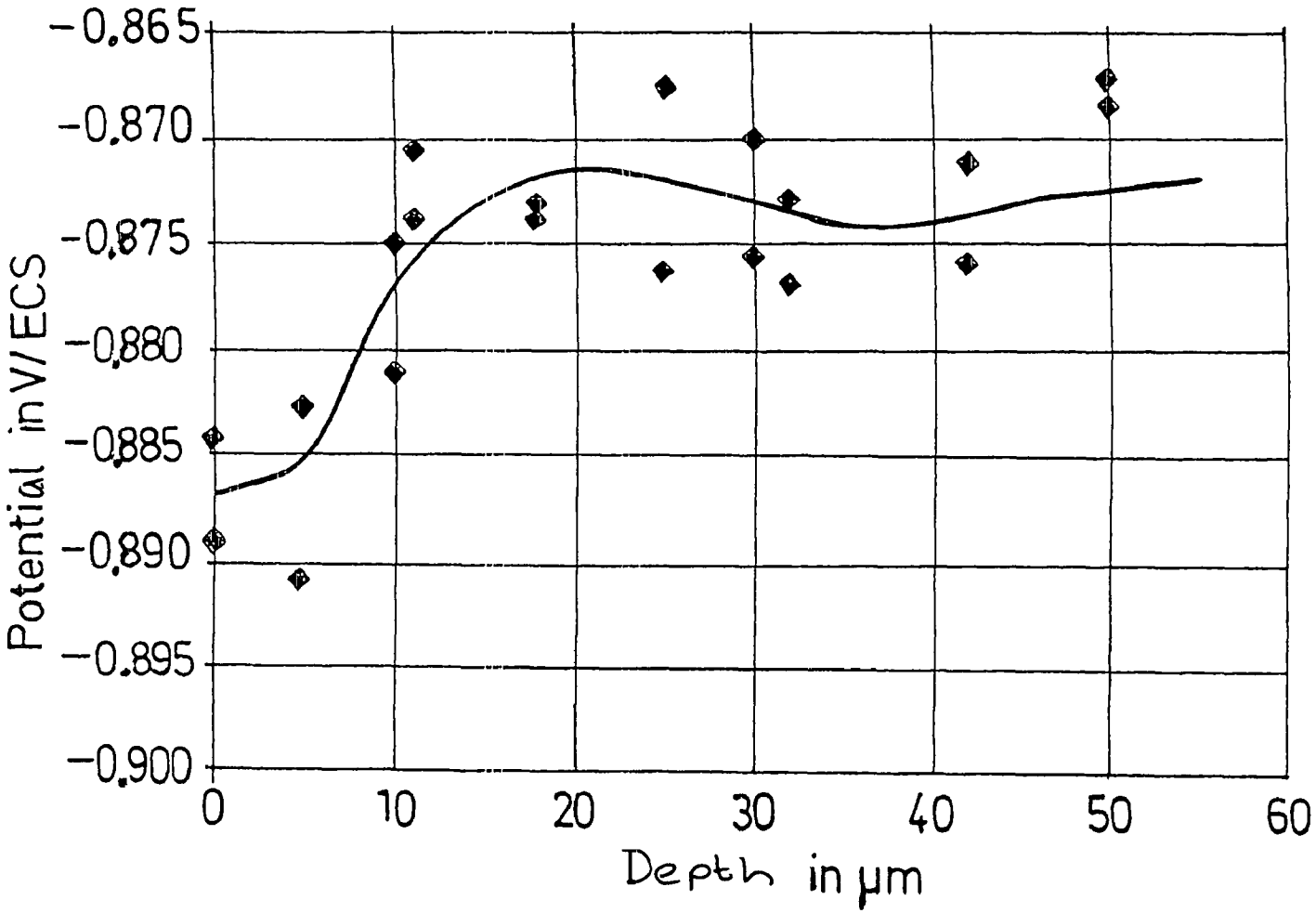
FIG. 1 shows the variation of the corrosion potential, measured with respect to a saturated calomel electrode, of a strip according to the invention made from the alloy in example 1 as a function of the depth from the surface.

The applicant found that by using continuous casting for type 3000 (Al—Mn) or type 8000 (Al—Fe) alloys, possibly with added zinc, under particular casting conditions and with an appropriate transformation procedure, strips could be obtained with a corrosion potential gradient through their thickness and that this property encourages lateral propagation of corrosion rather than propagation perpendicular to the surface, which achieves the sacrificial effect while avoiding perforation and therefore damage to the fin or the separator with time. This potential gradient is at least 10 mV. According to one assumption made by the inventors, this difference could be related to the presence of segregations in the strip core under particular selected casting conditions, a phenomenon that would normally be avoided and that leads to differences in the composition in solid solution within the thickness of the strips.

The zinc content varies as a function of the alloy used for the tubes, so as to obtain an electrochemical potential difference between the tubes and the fins that is both sufficient for the fin to act as sacrificial anode, and is not too high so that it does not deteriorate too quickly. The corrosion potential of the fin or separator can be lowered by also adding indium, tin and/or bismuth up to a content of 0.2%. For 3003 alloy tubes, the zinc content is preferably between 1.0 and 1.5%. For tubes made of an Al—Mn alloy with a higher content of zinc, for example such as alloys with more than 0.4% copper described in patent application EP 1075935 issued by the applicant, the zinc content should be kept below 0.8%.

The copper content is preferably kept below 0.5%. The possible addition of up to 0.2% of titanium, up to 0.25% of zirconium and/or up to 0.25% of chromium improves the resistance of the alloy when hot (SAG resistance).

In a first variant of the invention, the alloy used is a 3003 type alloy with a zinc content of up to 2%, in other words an alloy with the following composition (% by weight):

Si<1.0; Fe<1.0; Cu<0.8; Mg<1.0; Mn=0.8-1.8 Zn<2.0; In<0.2; Sn<0.2; Bi<0.2; Ti<0.2; Cr<0.25; Zr<0.25; other elements <0.05 each and <0.15 in total, the remainder being aluminium.

The addition of silicon, preferably more than 0.5% and up to 1%, contributes to increasing the solidification interval of the alloy, which encourages the occurrence of segregations during casting. At more than 1%, there is a risk of reaching the alloy burning temperature during the exchanger brazing operation.

In a second variant of the invention, an alloy in the 8000 series is used with the following composition (% by weight):

Si=0.2-1.5; Fe=0.2-2.5; Cu<0.8; Mg<1.0; Mn=<1.0; Zn<2.0; In<0.2; Sn<0.2; Bi<0.2; Ti<0.2; Cr<0.25; Zr<0.25; Si+Fe>0.8, other elements <0.05 each and <0.15 in total, the remainder being aluminium.

One particularly suitable composition range is as follows:

Si=0.8-1.5; Fe=0.7-1.3; Mn<0.1; Cu<0.1; Mg<0.1, and preferably Si=1.0-1.3 and Fe=0.9-1.2.

The method for manufacturing strips according to the invention includes the production of the alloy from a filler adjusted to obtain the required alloy composition. The metal is then cast continuously in the form of a strip with a thickness of between 1 and 30 mm, either by a twin-belt casting to between 12 and 30 mm, or preferably by casting between two cooled rolls shrinked with shells to a thickness of between 1 and 12 mm. Unlike what is stated in patent application WO 98/52707, the casting parameters are chosen to encourage the appearance of relatively important segregations in the cast strip core.

In the case of twin-roll casting, the contact between the metal and the cooled cylinders should be as good as possible, so as to increase the temperature gradient at the metal surface during casting, which encourages segregations. The different parameters on which action can be taken are particularly the length of the contact arc between the metal and the rolls, the force applied by the rolls during casting and the temperature of the roll shells. A long contact arc, preferably longer than 60 mm, encourages the formation of segregations. Similarly, a high force, preferably more than 100+2000/e t/m of width of the cast strip, where e is the thickness of the cast strip expressed in mm, also encourages segregation. Finally, the temperature of the shells must be as low as possible, and preferably less than 100° C.

The cast strip may be hot rolled and then cold rolled in the case of twin-belt casting. However, twin-roll cast strip is cold rolled directly. If the final thickness is fairly small, then at least one intermediate annealing is necessary at a temperature of between 200 and 450° C. If the metal has to be delivered in the annealed temper, then annealing at a temperature of between 200 and 450° C. is carried out on the rolled strip until the final thickness. If the metal is delivered in the strain-hardened temper, the transformation procedure is adapted such that the reduction ratio is adjusted to the target strain-hardening ratio.

Strips according to the invention are used to make heat exchanger fins or separators with high mechanical strength, so that the thickness can be reduced below the thicknesses used for fins or separators according to the prior art, while maintaining good formability. In service, the fin or the separator acts as a sacrificial anode, but corrosion progresses laterally parallel to the surface, which avoids or retards perforation, assures integrity of the tube-fin assembly and therefore a continuous heat exchange. Strips with a coarse grain microstructure are favourable to hot resistance during brazing.

EXAMPLE

Example 1

An alloy with the following composition (% by weight) was prepared in a melting furnace:

| Si | Fe | Cu | Mn | Mg | Cr | Ni | Zn | Ti |
|---|---|---|---|---|---|---|---|---|
| 0.80 | 0.55 | 0.10 | 1.0 | 0.069 | 0.002 | 0.005 | 1.4 | 0.015 |

A 5 mm thick strip was cast on a Jumbo 3 Cm™ continuous casting installation made by the Pechiney Rhenalu Company with a width of 1420 mm with a force between rolls equal to 780 t, a 70 mm contact arc was obtained with the temperature of the roll shells being equal to 70° C. The strip was then cold rolled in a single pass down to a thickness of 0.7 mm and was then subjected to 12 h intermediate annealing in an air furnace programmed to 520° C. to bring the metal to a temperature of the order of 380° C., and cold rolled in three passes down to 130 μm.

A first part of the strip was subjected to a recovery annealing for 2 h at 350° C., followed by rolling to 100 μM. A second part was subjected to recrystallisation annealing for 2 h at 400° C., and then rolled to 100 μm. Finally, the same annealing was carried out in a third part, which was rolled to 75 μm. For comparison, 3003 zinc alloy strips were made with the following composition:

| Si | Fe | Cu | Mn | Mg | Cr | Ni | Zn | Ti |
|---|---|---|---|---|---|---|---|---|
| 0.22 | 0.57 | 0.12 | 1.15 | — | — | — | 1.4 | — |

using the same manufacturing procedure, but starting from a vertical semicontinuous casting process with a recovery annealing for 2 h at 350° C., and rolling up to 100 μm.

Static mechanical properties of these strips were measured including the yield shength $R_{0.2}$, tensile strength $R_m$ and elongation A. The results are shown in table 1:

| Procedure | Thickness (μm) | $R_{0.2}$ (MPa) | $R_m$ (MPa) | A (%) |
|---|---|---|---|---|
| CC annealed at 350° C. | 100 | 235 | 248 | 3.2 |
| CC annealed at 400° C. | 100 | 188 | 197 | 2.4 |
| CC annealed at 400° C. | 75 | 213 | 227 | 1.8 |
| CV annealed at 350° C. | 100 | 158 | 162 | 1.5 |

*CC = continuous casting; CV = vertical semicontinuous casting.

It is found that the metal obtained by continuous casting has both a better mechanical strength and better elongation than metal derived from traditional casting.

The variation of the corrosion potential through the thickness compared with a saturated calomel electrode according to ASTM standard G69 was measured on the 75 μm strip. The figure shows the presence of a zone under the surface and at a depth of about 15 μm, in which the potential quickly changes from −890 mV to −870 mV.

Example 2

An alloy was prepared with the following composition (% by weight):

| Si | Fe | Cu | Mn | Mg |
|---|---|---|---|---|
| 1.2 | 1.1 | <0.1 | <0.1 | <0.1 |

A 6.1 mm thick and 1740 mm wide strip was cast on a Davy™ continuous casting installation made by the Pechiney Eurofoil Company, with a force between the rolls of 550 t, a contact arc of 60 mm and a temperature of the roll shells equal to 42° C. The strip was then cold rolled to a thickness of 80 μm to obtain an H19 type metallurgical temper.

The mechanical characteristics of this strip are as follows:

| $R_m$ (MPa) | $R_{0.2}$ (MPa) | A % |
|---|---|---|
| 311 | 256 | 7.3 |

It can be seen that this metal produced by continuous casting has an excellent compromise between mechanical strength and elongation.

The metal was then subjected to a typical brazing cycle in a furnace under a nitrogen atmosphere, comprising a 2-minute plateau at 600° C.

The mechanical characteristics obtained after this treatment are as follows:

| $R_m$ (MPa) | $R_{0.2}$ (MPa) | A % |
|---|---|---|
| 135 | 53 | 13.2 |

The yield strength after brazing, $R_{0.2}$, equal to 53 MPa is significantly better than the value obtained for the 3003 alloy strips used traditionally, obtained by conventional casting (of the order of 40-45 MPa).

Figure 2:
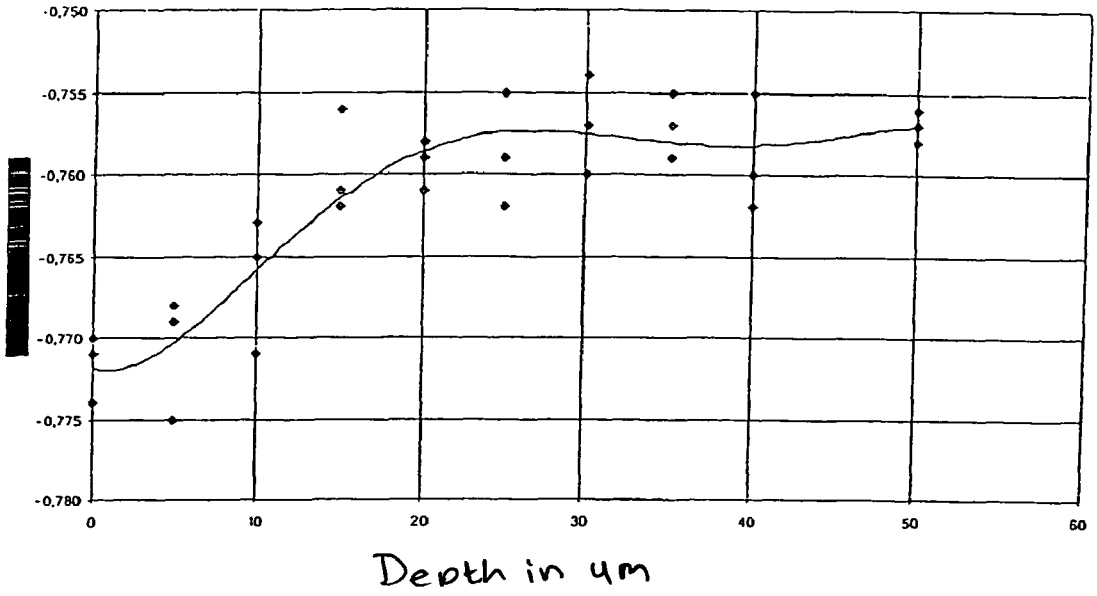
FIG. 2 shows the variation of the corrosion potential of a strip made from the alloy according to example 2.

From the point of view of corrosion resistance, a variation of the corrosion potential occurs within the thickness of the metal with these 8xxx alloys, as can be seen in FIG. 2, always in relation to the casting process used; the beneficial nature of this variation has been explained above for 3xxx alloys.

It would be possible to add zinc to adapt the corrosion potential to the corrosion potential of alloys used for tubes with which the separators will be coupled, since zinc has only a very minor influence on the mechanical characteristics or the thermal conductivity.

The invention claimed is:

1. Aluminum alloy strips with thickness <0.3 mm, to be used in the manufacture of brazed heat exchangers, with composition consisting essentially of (% by weight):

Si<1.5; Fe<2.5; Cu<0.8; Mg<1.0; Mn≦1.8; Zn<2.0; In<0.2; Sn<0.2; Bi<0.2; Ti<0.2; Cr<0.25; Zr<0.25; Si+Fe+Mn+Mg>0.8, other elements <0.05 each and <0.15 in total, with a difference of corrosion potential between surface and mid-thickness, measured with respect to a saturated calomel electrode according to ASTM standard G69 equal to at least 10 mV.

2. Strips according to claim 1, wherein the zinc content is between 1.0 and 1.5%.

3. Strips according to claim 1, wherein the zinc content is below 0.8%.

4. Strips according to claim 1, wherein the copper content is below 0.5%.

5. Strips according to claim 1, made from an alloy consisting essentially of: Si<1.0; Fe<1.0; Cu<0.8; Mg<1.0; Mn=0.8-1.8 Zn<2.0; In<0.2; Sn<0.2; Bi<0.2; Ti<0.2; Cr<0.25; Zr<0.25; other elements <0.05 each and <0.15 in total, the remainder being aluminum.

6. Strips according to claim 5, wherein the silicon content is between 0.5% and 1%.

7. Strips according to claim 1, made from an alloy consisting essentially of: Si=0.2-1.5; Fe=0.2-2.5; Cu<0.8; Mg<1.0; Mn≦1.0; Zn<2.0; In<0.2; Sn<0.2; Bi<0.2; Ti<0.2; Cr<0.25; Zr<0.25; Si+Fe>0.8, other elements <0.05 each and <0.15 in total, the remainder being aluminum.

8. Strips according to claim 7, made from an alloy consisting essentially of: Si=0.8-1.5; Fe=0.7-1.3; Mn<0.1; Cu<0.1; Mg<0.1.

9. Strips according to claim 8, wherein the silicon content of the alloy is between 1 and 1.3%.

10. Strips according to claim 8, wherein the iron content is between 0.9 and 1.2%.

11. Aluminum alloy strips with thickness <0.3 mm, to be used in the manufacture of brazed heat exchangers, with composition consisting essentially of (% by weight):

Si<1.5; Fe<2.5; Cu<0.8; Mg<1.0; Mn≦1.8; Zn<2.0; In<0.2; Sn<0.2; Bi<0.2; Ti<0.2; Cr<0.25; Zr<0.25; Si+Fe+Mn+Mg>0.8, other elements <0.05 each and <0.15 in total, said strips being produced by continuous casting at a thickness of between 1 and 30 mm under conditions that promote the formation of segregations in the strip core, between two cooled and shrinked rolls, the force applied by the rolls during casting being more than 100+2000/e t/m of width of the cast strip, where e is the thickness of the cast strip expressed in mm, with a contact arc between the metal and the rolls longer than 60 mm, and the rolls having shells with a temperature of less than 100° C., the strips having a difference of corrosion potential between surface and mid-thickness, measured with respect to a saturated calomel electrode according to ASTM standard G69 equal to at least 10 mV.

12. Strips according to claim 11, wherein the zinc content is between 1.0 and 1.5%.

13. Strips according to claim 11, wherein the zinc content is below 0.8%.

14. Strips according to claim 11, wherein the copper content is below 0.5%.

15. Strips according to claim 11, made from an alloy consisting essentially of: Si<1.0; Fe<1.0; Cu<0.8; Mg<1.0; Mn=0.8-1.8 Zn<2.0; In<0.2; Sn<0.2; Bi<0.2; Ti<0.2; Cr<0.25; Zr<0.25; other elements <0.05 each and <0.15 in total, the remainder being aluminum.

16. Strips according to claim 15, wherein the silicon content is between 0.5% and 1%.

17. Strips according to claim 11, made from an alloy consisting essentially of: Si=0.2-1.5; Fe=0.2-2.5; Cu<0.8; Mg<1.0; Mn<1.0; Zn<2.0; In<0.2; Sn<0.2; Bi<0.2; Ti<0.2; Cr<0.25; Zr<0.25; Si+Fe>0.8, other elements <0.05 each and <0.15 in total, the remainder being aluminum.

18. Strips according to claim 17, made from an alloy consisting essentially of: Si=0.8-1.5; Fe=0.7-1.3; Mn<0.1; Cu<0.1; Mg<0.1.

19. Strips according to claim 18, wherein the silicon content of the alloy is between 1 and 1.3%.

20. Strips according to claim 18, wherein the iron content is between 0.9 and 1.2%.

* * * * *